US005342537A

United States Patent [19]

Conville et al.

[11] Patent Number: 5,342,537

[45] Date of Patent: Aug. 30, 1994

[54] RAPID COOLING SYSTEM CLEANING FORMULATIONS

[75] Inventors: John J. Conville, Canton; James T. Lyon, Novi; Turcotte, Woodhaven, all of Mich.

[73] Assignee: BASF Corporation, Parsippany, N.J.

[21] Appl. No.: 980,852

[22] Filed: Nov. 24, 1992

[51] Int. Cl.[5] ..... C11D 3/37; C11D 3/33; C11D 3/60

[52] U.S. Cl. ..... 252/174.24; 252/135; 252/174.21; 252/527; 252/546; 252/DIG. 2; 252/DIG. 11

[58] Field of Search ..... 252/174.24, 82, 86, 252/87, 135, 156, 546, 174.21, 527, DIG. 2, DIG. 11, 180, 181

[56] References Cited

U.S. PATENT DOCUMENTS

| | | | |
|---|---|---|---|
| 2,503,381 | 4/1950 | Eichwald | 252/135 |
| 2,802,788 | 8/1957 | Flaxman | 252/105 |
| 2,824,069 | 2/1958 | Hall | 252/539 |
| 3,085,916 | 4/1963 | Zimmie et al. | 252/174.24 |
| 3,419,501 | 12/1968 | Levy | 252/527 |
| 3,578,589 | 5/1971 | Hwa et al. | 252/180 |
| 3,663,448 | 5/1972 | Ralston | 252/180 |
| 3,948,792 | 4/1976 | Watsën et al. | 252/181 |
| 3,959,166 | 5/1976 | Oberhofer et al. | 252/146 |
| 3,962,109 | 6/1976 | Oberhofer et al. | 252/146 |
| 4,277,359 | 7/1981 | Lipinski | 252/181 |
| 4,279,768 | 7/1981 | Busch | 252/180 |
| 4,363,741 | 12/1982 | Gould | 252/142 |
| 4,487,712 | 12/1984 | Wilson et al. | 252/78.3 |
| 4,540,443 | 9/1985 | Barber | 252/86 |
| 4,762,638 | 8/1988 | Dollman et al. | 252/135 |
| 4,810,406 | 3/1989 | Jabalee | 252/87 |
| 5,023,011 | 7/1991 | Busch et al. | 252/180 |
| 5,050,549 | 9/1991 | Sturmon | 134/22.14 |
| 5,062,987 | 11/1991 | Turcotte et al. | 252/156 |
| 5,071,582 | 12/1991 | Conville et al. | 252/81 |

FOREIGN PATENT DOCUMENTS 0245557 11/1987 European Pat. Off. .

*Primary Examiner*—Paul Lieberman
*Assistant Examiner*—A. Hertzog

[57] ABSTRACT

The present invention provides automotive cooling system cleaning formulations suitable for addition to antifreeze/coolant systems. The cleaning compositions use a mixture of a metal cleaning compound such as EDTA, polymeric polycarboxylates and alkoxylated alcohol based nonionic surfactants to provide rapid cleaning of the coolant system. The cleaning formulation is then removed from the cooling system.

6 Claims, No Drawings

RAPID COOLING SYSTEM CLEANING FORMULATIONS

BACKGROUND OF THE INVENTION

1. Field of the Invention

This invention relates to cooling system cleaning formulations or flushes, and more specifically, to cleaning formulations without corrosion inhibitor packages which may be added to antifreeze/coolant compositions for rapid cleaning.

2. Description of the Prior Art

Antifreeze/coolants in North America generally use silicate based corrosion inhibitor packages. Silicates are particularly useful in protecting aluminum automotive cooling system components. The silicate corrosion inhibitors generally also use a phosphate, usually in the form of an alkali metal salt, to help protect metal cooling system parts and also as a buffer to control the pH of the coolant. Often phosphate salts are used to help maintain a stable alkaline environment from which multiple corrosion inhibitors can most effectively function.

Traditionally antifreeze/coolant is sold at nearly one-hundred percent glycol content. This concentrated packaging allows for flexibility so that the user can dilute the antifreeze/coolant, as needed, with available water to obtain the required freeze/boil protection.

In addition, during extended operation of the automotive cooling system, the corrosion inhibitor formulations in the antifreeze/coolant composition become depleted, thereby reducing corrosion inhibition. Once the corrosion inhibition packages cease functioning, corrosion product build up generally begins occurring on the metal surfaces of the cooling system. In addition, automotive oil and grease from contamination and leakage may also build up on the surfaces of the cooling system due to prolonged operation of the vehicle.

While corrosion inhibitor packages may be added to depleted antifreeze/coolant compositions to prolong the life of the antifreeze/coolant and to replenish corrosion inhibition properties, there remains a residual build up of oil, grease and corrosion products in the coolant system. A cleaning composition is generally needed to eliminate the build up of foreign substances in the coolant system.

Currently, most prior art cleaners contain chelators and corrosion inhibition packages. See, for example, U.S. Pat. Nos. 4,540,443; 5,062,987; and 5,071,582. The corrosion inhibition packages are designed to provide corrosion protection while the chelators clean the cooling system metal components. The balance between corrosion inhibition and metal cleaning requires that the cleaner be added and be maintained in the coolant system for a long period of time. Therefore, the cleaning component operates very slowly and remains in the system for an extended period of from hours to days.

These cleaners do not contain dispersants, such as polycarboxylates, to aid in the removal of particulate matter like hard water precipitates. Also, they neither address oil and grease removal nor the foaming tendency during engine application.

The use of EDTA, NTA, inorganic alkali metal phosphates and surfactants at a pH of 11 to 12.5 is disclosed to clean aluminum cars in U.S. Pat. No. 4,762,638. Such a formulation is too alkaline, and hence corrosive, for automobile cooling systems. In addition, there is no dispersant in the formulation.

U.S. Pat. No. 3,962,109 discloses an automotive cleaner plus inhibitor for cooling systems. The formulation is impregnated on a cooling system filter and is a permanent addition to the vehicle cooling system. The cleaner is never flushed out of the system and the filter is replaced every six months. U.S. Pat. No. 4,260,504 discloses deposit control additives for heat exchange systems, but does not involve cleaning or degreasing.

U.S. Pat. No. 4,363,741 discloses a rapid cooling system cleaner to remove rust scale and grease. The formulation consists of water, citric acid and oxypolyethoxyethanol as a surfactant at a pH of 4.5 to 8.5 and preferably 5.5 to 6.5. This formulation lacks a dispersant to aid particulate suspension and removal. U.S. Pat. No. 4,810,406 discloses a silicone silicate, phosphoric acid and water based cooling system treatment to dissolve corrosion and deposits. This patent does not have the capacity to remove grease and oil. In addition, the formulation contains no dispersant.

Certain polycarboxylate type materials have been disclosed for prevention of precipitates in antifreeze/coolant compositions. For example, U.S. Pat. No. 3,663,448 discloses scale inhibition for industrial cooling waters using amino phosphonate and polyacrylic acid compounds. U.S. Pat. No. 3,948,792 discloses an aqueous additive mixture to reduce and modify the amount of silicate scale formed in automotive cooling systems.

European patent 245557 discloses the use of a variety of compounds including sodium polyacrylate to prevent alkaline earth metal silicate precipitation. U.S. Pat. No. 4,487,712 discloses the use of polyacrylic acid as a silicate stabilizer to inhibit gelation. Gelation is a silicate depletion mechanism which can occur separately from hard water precipitates.

In spite of these disclosures, there remains a need for a rapid coolant system cleaning formulation that works quickly in the coolant system and is then removed.

BRIEF SUMMARY OF THE INVENTION

The present invention has met the above-described need by providing flush formulations for cooling systems by using a mixture of metal cleaners, surfactants to remove oil and grease and a dispersant and sequestrant. Specifically, the flush formulations of the present invention are a mixture of ethylenediamine tetracetic acid (EDTA), alkoxylated alcohol based nonionic surfactants and polymeric polycarboxylates. The flush is added to the cooling system for rapid cleaning and is then removed. The formulations of the present invention are compatible with other commonly used antifreeze/coolant components, does not corrode or damage automotive cooling systems and is effective at relatively low concentrations.

It is an object of the present invention to provide cleaning formulations for cooling systems containing foreign deposits.

It is an additional object of the present invention to provide flush formulations which are effective at rapidly cleaning a cooling system.

If is a further object of the present invention to provide cooling system cleaning which are a mixture of EDTA, alkoxylated alcohol based nonionic surfactants and polymeric polycarboxylates.

It is an object of the present invention to provide coolant cleaning formulations which are compatible with commonly used antifreeze/coolant components and cooling systems.

It is another object of the present invention to provide cooling system cleaning formulations which are effective at relatively low concentrations.

These and other objects of the present invention will be more fully understood from the following description of the invention.

DETAILED DESCRIPTION OF THE PREFERRED EMBODIMENTS

The present invention provides cooling system cleaning formulations for coolant systems of a mixture of EDTA, certain polymeric polycarboxylates and alkoxylated alcohol based nonionic surfactants which provide rapid cleaning of a cooling system.

The present formulation is primarily intended for light corrosion product removal which might result from improper or poor cooling system maintenance. This formulation can remove oil and grease deposits from the cooling system also. These contaminants may enter the cooling system by, for example, water pump failure or using an oil change pan for filling the cooling system without adequate cleaning. The present formulations can suspend particulate matter, such as hard water precipitates, and so facilitate their removal from the cooling system. Such particulates are a source of abrasive wear.

The present cooling system cleaning formulation is soluble in glycol, glycol/water mixtures and in water alone and exhibits excellent stability characteristics. The cooling system cleaning formulations are compatible with other commonly used antifreeze/coolant components and are effective at relatively low concentrations.

The cooling system cleaning formulations of the present invention are a water-based mixture of EDTA, polymeric polycarboxylates and alkoxylated alcohol based nonionic surfactants. Optionally, other components including defoamers, acids, bases, dyes, bittering agents, solvents, chelators, glycols, and the like may be added to the present formulation.

The cooling system cleaner of the present invention uses a metal cleaning component. The salts of ethylenediamine tetraacetic acid (EDTA) are preferred for cleaning of cooling system metals. These salts include, for example, the tetrasodium salt of EDTA. However, other common chelators such as trisodium nitrilotriacetate, sodium hydroxide, sodium gluconate, sodium citrate, sorbitol, mixtures thereof and the like may also be used.

The most preferred metal cleaner is a solution of about 39% of the tetrasodium salt of EDTA. This solution is available commercially as Versene 100 from Dow Chemical Corporation, Midland, Mich.

The metal cleaning component is preferably present in an amount of about 5 to about 50 percent by weight, and more preferably from about 10 to about 20 weight percent.

The preferred class of polymeric polycarboxylates are based on polyacrylic acid (PAA) and/or polymaleic acid (PMA). These polymeric polycarboxylates are compatible with other components in the typical antifreeze/coolant composition, and present no additional toxicity or disposal concerns. The polymeric polycarboxylates function as a dispersant and a sequestrant in the present cleaning formulation.

Other polymeric polycarboxylate materials which are useful in the present invention include Belclene® water treatment additives from Ciba-Geigy, Colloid additives from Colloids, Inc. Good-rite® polyacrylates and Carbopol® resins from BF Goodrich and the like.

The molecular weight distribution of useful materials may average about one hundred grams/mole to about three million grams/mole. Chemically, the materials should be based on polymers and copolymers of acrylic acid and maleic acid, including any modifiers, such as alcohols.

The polycarboxylates used in the present invention have a molecular weight range of from about 500 to about 250,000, with a preferred range of from 500 to 12,000. More specifically, the most preferred additives have average molecular weights in the range of about 500 to about 4,000, and more specifically about 1300 to about 1800.

When reference is made to polycarboxylates within the context of the present invention it is understood to encompass those water-soluble homo- and copolymers having at least one monomeric unit containing $C_{3-6}$ monoethylenically unsaturated mono- or dicarboxylic acids or their salts. Suitable monocarboxylic acids of this type are for example, acrylic acid, methacrylic acid, ethacrylic acid, vinylacetic acid, allylacetic acid, and crotonic acid. The preferable monocarboxylic acids from this group are acrylic acid and methacrylic acid. The polycarboxylate may be a copolymer comprised of monomeric units of monoethylenically unsaturated $C_{4-6}$ dicarboxylic acids, for example, maleic acid, itaconic acid, citraconic acid, mesaconic acid, fumaric acid, or methylenemalonic acid (preferably maleic acid), and its salts, and at least one other monoethylenically unsaturated substituted monomer. The substituent groups are preferably selected from the group consisting of alkylvinylethers, olefins, and vinyl esters and amides of carboxylic acids. Most preferably the polymeric polycarboxylate is selected from the group consisting of homopolymers of acrylic acid and its sodium salts, and homopolymers of acrylic acid modified with an aliphatic, secondary alcohol.

Other organic substituents may be used as comonomers or as modifiers added along the polymer chain. Examples of such are shown as Formula I.

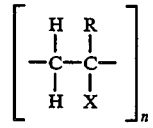

(I)

where R=H or a secondary alcohol such as isopropanol, X=COOH, $COO^-Na^+$, methylvinylether, isobutylene, vinyl acetate, acrylamide, or styrene, with the proviso that when R= a secondary alcohol, X=COOH or $COO^-Na^+$, and when X= any other above referenced group, R=H. The preferred polycarboxylates are a copolymer of acrylic acid and maleic acid, or their sodium salts, said copolymer having a molecular weight of 3000, and a sodium salt of polyacrylic acid modified with a secondary alcohol such a isopropanol, said polymer having a molecular weight of 4000.

The polycarboxylates used in the present invention are obtained by methods well known to those skilled in the art. The general method of synthesis is via free acid radical polymerization. The polymerization may be carried out in an aqueous medium, in the presence of polymerization initiators, with or without regulants.

The polymerization can take various forms; for example, the monomer(s) can be polymerized batchwise in the form of aqueous solutions. It is also possible to introduce into the polymerization reactor a portion of the monomer(s) and a portion of the initiator, to heat the mixture in an inert atmosphere to the polymerization temperature and then to add the remaining monomer(s) and initiator to the reactor at the rate of polymerization. Polymerization temperatures range from 20° C. to 200° C. At temperatures above 100° C., pressure vessels are employed.

The carboxyl containing monomers can be polymerized in the free carboxylic acid form, in the partial neutralized form, or completely neutralized. The neutralization is preferably effected with alkali metal or ammonium base.

The polymerization initiators used are preferably water soluble free radical formers such as hydrogen peroxide, peroxodisulfates and mixtures of the two. The polymerization may also be started with water insoluble initiators such as dibenzoyl peroxide, dilaurylperoxide, or azodiisobutyronitrile. The polymerization may be carried out in the presence of regulants. Examples of such regulants include water soluble mercaptans, ammonium formate, and hydroxylammonium sulfate.

Examples of the polycarboxylates which may be used in the present invention are those marketed by BASF under the trademark SOKALAN ® polycarboxylates, which are available in aqueous polymer solutions.

The polymeric polycarboxylate is effective at relatively low concentrations, generally about 100 to about 1000 ppm per total volume of antifreeze/coolant. The polymeric polycarboxytate is preferably present in the formulation in an amount of about 0.01 to about 25 percent by weight, and more preferably in an amount of about 0.5 to about 1.0 percent by weight.

While one preferred additive, Sokalan ® CP 12S, has been shown to be particularly effective at about 0.7 weight percent, other levels of additive and different polycarboxylates, including SOKALAN ® CP 10 may also be used. In addition, other commercially available polycarboxylates such as, for example, Belclene polymers from Ciba-Geigy; Goodrite and Carbopol polymers from B. F. Goodrich and Colloid polymers from Colloid, Inc., may be used.

Nonionic surfactants are used in the present formulation as degreasers and oil removers. In addition, the suitable nonionic surfactant should be substantially nonfoaming at engine operating temperatures. The use of a non-foaming nonionic surfactant reduces the chance of a radiator/bottle overflow during the cleaning process due to foam formation. In addition, incomplete removal of a high foaming surfactant would result in repeated recleaning to remove the residual surfactant.

The preferred surfactant to be used in cleaning formulation of the present invention is nonionic. Nonionic surfactants can be broadly defined as surface active compounds which do not contain ionic functional groups. The preferred surfactants of the present invention are straight chain primary (linear) alcohol alkoxylates.

The nonionic surfactants useful in the present invention comprise ethylene oxide and/or propylene oxide and/or butylene oxide condensation products with alcohols, alkyl phenols, fatty acid amides and mixtures thereof. Preferably, the nonionic surfactant may be an oxyalkylate of the general structure:

$$RO(C_2H_4O)_x—(C_3H_6O)_y—(C_4H_8O)_z—H$$

wherein R is an alkyl chain whose length is from about 8 to 18 carbon atoms, preferably from about 12 to 15 carbon atoms; x is a number from about 4 to 15; y is a number from about 0 to 15, preferably 0 to 4; and z is a number from about 0 to 5, and preferably 0.

The preferred range of the molecular weight of the oxyalkylate surfactant for use in the present invention is from about 300 to 2,200.

One class of preferred nonionic surfactants are the reaction or condensation products of ethylene oxide and a suitable lipophile or lipophilic material. Higher alcohols, usually fatty alcohols of about 12 to 18 carbons atoms per molecule, are the preferred reactants with ethylene oxide to make the desired nonionic surfactants for the compositions of the present invention. In addition, oxo-type alcohols and middle phenols, such as nonyl phenols may also be useful. Other members of this well known class of nonionic surfactants, particularly the higher fatty acid esters of ethylene oxide, are also useful.

Preferably, a higher fatty alcohol is employed as the source of the lipophile and the product is a narrow range ethoxylate nonionic surfactant. Narrow range ethoxylate is defined as a polyethoxylated lipophile, ethoxylated with ethylene oxide so that at least 70% of the ethylene oxide in the nonionic surfactant is in polyethoxy groups having n to (n+8) moles of ethylene oxide per mole, wherein n may be from 1 to 10, although it is preferable that n be 3 to 5, more preferably 4. Thus, the narrow range ethoxylate (NRE) nonionic surfactant has at least 70% of the ethylene oxide thereof in polyethoxy groups of 4 to 12 ethylene oxides. Most preferably, such groups are of 5 to 10 ethoxy groups and are at least 80% of the ethoxy content of the NREs.

Instead of ethylene oxide, mixtures of ethylene oxide and propylene oxide may be employed in NREs, providing that the final product has the desirable properties of improved soil release, compared to wide range ethoxylate nonionic surfactants.

Although it may be preferred for the polyethoxylates of the NREs to be within certain ranges of ethoxy contents in the polyethoxy moieties thereof, manufacturing methods usually result in mixtures of polymers, so average ethoxy contents may be specified. Thus, the average NRE nonionic surfactants may be of an average of about 4 to 12 or about 5 to 10 ethylene oxide groups per mole, for example, averaging about 6 to 7 ethylene oxides per mole.

The preferred lipophile will be that from higher fatty alcohol and therefore, the ethylene oxide content of the NRE nonionic surfactants will be at least 70% of higher fatty alcohol ethoxylates averaging of about 5 to 10 ethylene oxide groups per mole and more preferably, at least 80% of the ethylene oxide will be in such higher fatty alcohol ethoxylates. This compares with about 50% or less of such polyethoxy groups in the wide range ethoxylates. Also, the higher fatty alcohol of the higher fatty alcohol ethoxylates will preferably be of 12 to 14 carbon atoms, although sometimes the fatty alcohol may be of about 10 to 16 or about 12 to 16 carbon atoms.

It is within the scope of the invention to employ synthetic lipophiles, such as those derivable from higher fatty alcohols of odd numbers of carbon atoms in the ranges given, or those derivable from higher fatty alcohols of even numbers of carbon atoms, as in natural products, and mixtures thereof.

NREs that are presently available are preferably manufactured by catalyzed condensation reactions which promote the production of a narrow range of polyethoxylates, rather than the more conventional broad range of polyethoxylates in the alkoxylated lipophile surfactant. Products produced catalytically are characterized by a normal distribution curve when ethylene oxide content (abscissa) is plotted against weight percent (ordinate), but the peak of the curve is much higher for the NRE than for the wide range ethoxylate nonionic surfactants. Similar products of similar distribution may be produced removing higher and lower polyethoxylates from the NREs or wide range ethoxylates, by solvent extractions, distillations, and other suitable processes.

The wide range ethoxylates will include lower percentages of a narrow range of desired polyethoxylates, such as those of about 4 to 12 or about 5 to 10 ethylene oxides, often less than 50%, compared to the NREs, which is often more than 70%. They will also include at least 1% of all unit degrees of ethoxylation from 1 to 16 or 1 to 2, even when it is desired to have the average or mean ethylene oxide content of at least 7 moles per mole.

The NRE which averages 7 moles of ethylene oxide per mole will usually have no higher polymer of ethylene oxide than 15, and the proportions of polyoxyethylene in the 4 to 12 and 5 to 10 ethylene oxide ranges will be significantly increased. Such increase and narrower distribution range of the polyethoxy moieties apparently changes the properties of the NRE for the better when it is included in a composition with the graft polymer described herein. Within the peak area of an NRE curve, as from 5 to 10 ethoxy groups per polyoxyethylene moiety, the percentages of the 5 to 10 ethylene oxide groups moieties for the NREs, compared to the wide range ethoxylates, may range from about 15 to 60% more, with the peak differences being for the 7 and 8 ethylene polyethoxylates.

Especially preferred nonionic surfactants of the present inventions are the linear alkoxylated alcohols, including narrow range linear ethoxylated alcohols. Suitable specific examples include Plurafac® D-25 and Plurafac® B-26, both from BASF Corporation.

Nonionic surfactants are preferably present in the formulation in an amount of about 0.1 to about 50 percent by weight, and more preferably in an amount of about 0.1 to about 1.0 percent by weight.

The pH of the cooling system cleaner is preferably about 8.0 to about 10.0. The pH may be adjusted with any compatible acid, such as phosphonic, nitric, acetic and nitrous acids, an mixtures thereof. However, due to the fact that many current antifreeze/coolant compositions contain phosphate, phosphoric acid is particularly preferred. A seventy five percent concentration of phosphoric acid is generally used to adjust the pH, however, any concentration is acceptable.

The acids may be present in the formulation in an amount of about 0,001 to about 10 percent by weight, and more preferably in an amount of about 0,001 to about 1.0 percent by weight.

The components of the cleaning formulations of the present invention may be added in any order and a specific rate of addition is not essential. However, it is preferred not to add the alkoxylated alcohol based nonionic surfactant first and the acid should be added last in order to ensure the proper pH.

For example, distilled water is rapidly agitated. Thereafter, the liquid Sokalan CP12S and Versene 100 is then added in any order and also mixed rapidly. The Plurafac D-25 is charged with continued rapid stirring. The mixing time for these components generally very short (about 10 minutes). It is preferred that the pH be between about 11.0 and 11.5. The pH is then adjusted to 9.0 using 75% phosphoric acid and stirred about 1 to 2 hours. In the event that the pH drifts, a small aliquot of acid may be added to maintain the pH at 9.0.

In addition to silicate-phosphate type coolants, these cooling system cleaning formulations may be added to silicate-borax, aminephosphate, amine-borax, organic acid-phosphate organic acid-borax type coolants, and the like. These cleaning formulations may be used in automotive applications. Such cooling system applications include power boats, farm equipment, off-road construction vehicles and power generating engines. Generally, the formulation could be used in any heat dissipating, liquid filled circuit.

The cooling system cleaning composition of the present invention is rapid acting, non-corrosive on aluminum, low pH and removes light corrosion products and cleans oil and grease from cooling systems.

The following examples serve to further illustrate the present invention and should in no way be construed as limiting the scope thereof.

EXAMPLES

Formulations used in the following examples are presented in Table 1. The flush formulations were designed for a 22 ounce bottle.

TABLE 1

| Formulations | A | B |
|---|---|---|
| Components (wt %) | | |
| Distilled Water | 82.694 | 82.70 |
| SOKALAN ® CP-12S | 0.7 | 0.7 |
| Versene 100 | 16.0 | 16.0 |
| Plurafac D-25 | 0.6 | 0.6 |
| 75% Phosphoric Acid | 0.006 | — |

Procedure for Blending

Distilled water was charged into a blending vessel and rapid agitation commenced. The liquid Sokalan CP12S is added and will dissolved quickly. The liquid Versene 100 was then added and also dissolved quickly. The Plurafac D-25 was then charged with continued rapid stirring. The oily liquid Plurafac D-25 initially floated on the surface, broke up and went into solution. The mixing time for these components was about 10 minutes and the pH should be between 11.0 and 11.5. The pH was adjusted to 9.0 using 75% phosphoric acid and stirred about 1 to 2 hours. In the event that the pH drifts, charge a small aliquot of acid to maintain the pH at about 9.0.

TABLE 2

| Physical Characteristics | A |
|---|---|
| Specific Gravity[1] | 1.0456 g/ml (15.6° C.) |
| Boiling Point | 213° F. |
| pH[2] | 9.45 |
| Effect on Automotive Plant[3] | Satisfactory |
| Effect on Cooling System Components[4] | No adverse effects |

TABLE 2-continued

| Physical Characteristics | A |
|---|---|
| Foam Test (break time)[5] | 2 seconds |

[1]ASTM D-1122
[2]ASTM D-1287
[3]ASTM D-1882
[4]Samples of cooling system components were placed in a solution of cooling system cleaner for 120 hours at room temperature.
[5]ASTM D-1881

Physical Testing

The physical properties and characteristics of the formulations of the present invention are detailed in Table 2. ASTM test methodology was used for the evaluation. The standard test methods D-1287-85, D-1122-90a and D-1881-86 are intended for engine coolants and were applied to the cleaner formulation. The scope of D-1882-88 includes cooling system cleaner and flush formulations. There are no ASTM or industry standard published performance criteria of acceptance for these formulations. However, the results presented in Table 2 imply acceptable performance on automotive paint, cooling system components and foam tendency.

Qualitative Spot Test

A 100% solution of pH 11.5 Formulation B of Table 1 was diluted to 10% with distilled water. The resultant pH was 10.88. The diluted formulation was spotted on copper, brass, mild steel, cast iron and aluminum coupons at room temperature and allowed to stand for one hour prior to qualitative visual examination. The aluminum coupon was visibly darkened and therefore corroded by each solution. The pH was too high, for automotive applications.

The pH of the solution (Formulation A of Table 1) was adjusted to 9.0 using 75% phosphoric acid. The solution was then spotted on the metal coupons. After one hour exposure, the coupons were visually evaluated. The aluminum coupon was not blackened or corroded.

Actual Usage

The flush formulation was tested in four vehicles according to the following instructions. The radiator cap was removed and the drain was opened at the bottom of the radiator to drain the radiator. The drain was then closed. The contents of a bottle (22 oz.) of Formulation A was added to the radiator and the system was filled with water.

The engine in each vehicle was started and the engine was allowed to reach normal operating temperatures. Once normal operating temperature was achieved, the engine was run for an additional ten minutes with the heater control on high. The engine was then turned off and allowed to cool.

The system is again drained. The radiator is then flushed with water with the engine turned on and the heater control on high. Flushing is continued until the flush water runs clear. The engine was then stopped and the system was allowed to completely drain.

Light rust and grease and oil that had accumulated in the cooling system was removed in all four vehicles.

ASTM D-1881-86

A modified ASTM D-1881-86 foam test was run with Formulation B and with Prestone brand cooling system cleaner. Both cleaners were run at 10% concentration. Fifteen milliliters of cleaner was added to 135 mls of distilled water. The solutions were stirred vigorously and the ASTM D-1881 test was run on both samples. The results are shown in Table 3.

TABLE 3

| Cleaner | Foam Volume (ml) | Break Time (secs.) |
|---|---|---|
| Prestone | Foamed out at >500 | 14 |
| Formulation B | 45 | 1.5 |

Table 3 shows that both the foam height is significantly smaller and the break time of formulation B is significantly shorter than that of the Prestone cleaner. In practical applications, this results in a virtually non-foaming cleaning formulation at actual engine temperatures. This is a result of the incorporation of the surfactant into the formulation. The material (Plurafac © D-25) has a cloud point of 34° C. (93.2° F.) and at elevated temperatures, such as in an engine or D-1881-86, acts as a defoamer.

Whereas particular embodiments of the invention have been described above for purposes of illustration, it will be appreciated by those skilled in the art that numerous variations of the details may be made without departing from the invention as described in the appended claims.

What is claimed is:

1. An aqueous automotive cooling system cleaning composition consisting essentially of:

(A) a metal-cleaning effective amount of a tetrasodium salt of ethylenediamine tetraacetic acid;

(B) between about 0.01 to about 25.0 percent by weight of a polycarboxylate additive which is at least one of (i) a secondary alcohol modified polyacrylic acid, and (ii) a sodium salt of a copolymer of acrylic acid and maleic acid;

(C) between about 0.01 to about 50 percent by weight of an alkoxylated alcohol-based nonionic surfactant; and (D) an acid in a sufficient amount to provide an effective composition pH of about 9.

2. A composition as in claim 1, wherein said tetrasodium salt of ethylenediamine tetraacetic acid is present in an amount between about 5 to about 50 percent by weight.

3. The composition as in claim 1, wherein the acid is at least one selected from the group consisting of phosphoric, nitric, acetic and nitrous acids.

4. The composition as in claim 1, wherein the acid is phosphoric acid which is present in an amount between about 0.001 to about 1.0 percent by weight.

5. A composition as in claim 1, wherein the nonionic surfactant is a narrow range linear alcohol ethoxylate.

6. The composition as in claim 5, wherein the nonionic surfactant is a higher fatty alcohol having about 12 to 14 carbon atoms in which over about 80% of the ethylene oxide content that is present are polyethoxy groups of about 5 to 10 moles of ethylene oxide per mole of said narrow range linear alcohol ethoxylate.

* * * * *